United States Patent [19]

Langner

[11] 4,019,721

[45] Apr. 26, 1977

[54] FLOWING FLUID MIXING DEVICE AND METHOD

[75] Inventor: Rene J. Langner, Chelsea, N.Y.

[73] Assignee: Bio/Physics Systems, Inc., Mahopac, N.Y.

[22] Filed: June 30, 1975

[21] Appl. No.: 591,482

[52] U.S. Cl. ..... 259/4 AC; 137/604

[51] Int. Cl.[2] ..... B01F 13/00

[58] Field of Search ..... 259/4 R, 4 AB, 4 AC, 259/DIG. 43; 137/604

[56] References Cited

UNITED STATES PATENTS

| | | | |
|---|---|---|---|
| 2,583,206 | 1/1952 | Borck | 259/4 AB |
| 3,378,234 | 4/1968 | Svec | 259/4 AB |
| 3,917,756 | 11/1975 | Rice | 259/4 R |

*Primary Examiner*—Robert G. Nilson
*Attorney, Agent, or Firm*—Curtis Alles

[57] ABSTRACT

A combination of substantially unmixed fluid materials which are flowing under conditions which normally result in laminar (non-turbulent) flow are mixed by passing the fluids upwardly into a chamber containing a heavy ball which is levitated above the chamber inlet by the flow of the fluids, resulting in an intimate mixing of the fluids.

19 Claims, 3 Drawing Figures

FLOWING FLUID MIXING DEVICE AND METHOD

CROSS REFERENCE TO RELATED CASES

U.S. Pat. No. 3,705,771 issued Dec. 12, 1972 to Mitchell Friedman, Louis A. Kamentsky and Isaac Klinger for PHOTOANALYSIS APPARATUS.

The present invention relates to mixing of flowing fluids, and the invention is particularly useful under conditions which normally cause laminar, non-turbulent, flow.

There are many requirements in the chemical, biological, and medical fields for fluid mixers which are operable on a continuous flow basis in which convergent streams of two or more fluids must be brought together and intimately mixed as the fluids flow through the apparatus. If conditions within the fluid flow apparatus are such as to naturally induce turbulence in the combination of fluids, then mixing occurs because of the turbulence, and no special measures may be required. However, under operating conditions which naturally lead to laminar rather than turbulent flow, very little mixing occurs, and the individual liquids in the combination of liquids flow in separate layers in the stream without mixing. In accordance with known principles of fluid dynamics, the tendency of a particular fluid flow system to provide either turbulent flow or laminar flow is dependent upon various physical factors of the system as expressed by a Reynolds number. The formula for the Reynolds number for a smooth walled tube may be expressed as follows: $Dv/u$ where:

D is the diameter of the tube in millimeters.

$v$ is the velocity of the fluid in the tube in millimeters per second.

$u$ is the kinematic viscosity of the fluid in centipoises.

If the Reynolds number is 2,000 or less, laminar flow always occurs, and if there is any turbulence of the fluids as they enter the tube, that turbulence tends to subside, and the flow becomes laminar as it passes through the tube. If the Reynolds number is greater than 3,000, the flow is always turbulent. For Reynolds numbers between 2,000 and 3,000, the flow may be characterized as transitional in nature. That is, the flow may be turbulent or laminar, or a combination of the two.

It is one important object of the present invention to provide for thorough mixing of a combination of two or more fluids which are flowing under conditions in which the Reynolds number is less than 2,000 so that turbulence mixing is not normally available.

In many mixing situations, such as in chemical and biological research, and particularly in the medical field, it is important for reasons of economy, and because of restrictions on availability, to deal with very small volumes of liquids. Such small volumes necessarily require the mixing apparatus to employ small physical dimensions, which inevitably result in what is normally a laminar flow system having a low Reynolds number. As explained more fully below, the present invention has been applied to a flow mixing system having a basic flow diameter in the order of only one millimeter.

Accordingly, it is another object of the invention to provide a flow mixing device which is effective for accomplishing thorough mixing in a flow system which handles very small volumes of fluid.

If batch processing can be used, the normal approach for mixing two or more fluids is to place the fluids in a common container, and agitate those fluids to obtain the desired mix. However, such a procedure is time consuming, involves serious waste, when very small samples are available, and is costly in requiring considerable quantities of materials in cleansing the batch mixing apparatus between batches.

Accordingly, it is another object of the present invention to provide an efficient flow mixer which requires an absolute minimum in volume of the fluids to be mixed for the purpose of charging the mixer, and which is capable of efficiently handling very small batches, and which is easily and efficiently cleansed between batches.

The difficulties in obtaining thorough mixing of fluids in a flow mixer are greatly increased when the fluids are to be mixed with a very high ratio between the volumes of two of the fluids. For instance, the present invention is efficiently employed in mixing two fluids in a ratio in the order of 60 to 1 in volumes.

Accordingly, it is another object of the present invention to provide a fluid mixer which is effective to mix fluids in high volume ratios.

The problems in mixing two or more fluids are also greatly increased by differences in the natures of the different fluids such as different viscosities, and different specific gravities.

Accordingly, it is another object of the invention to provide a fluid flow mixer which is efficient in mixing dissimilar fluids.

An important purpose for which mixers dealing with small volumes of fluids are required is in the preparation of samples of biological cells, such as blood cells, for analysis in continuous flow cell analyzing equipment. Equipment of this nature is disclosed for instance in U.S. Pat. No. 3,705,771. In the equipment described in that patent, biological cells, such as blood cells, are passed through an optical chamber in a very thin stream with only one cell at a time being presented in the liquid stream. In order to assure a liquid stream which presents only one cell at a time, with a reasonable separation between cells, a sample of cells such as a sample of raw blood, must be substantially diluted, preferably in a ratio as high as 4,000 to 1. The preferred diluent is basically a saline solution of water. Because of the peculiar nature of blood, in which almost half of the volume is taken up by blood cells, which tend to remain together in clusters, non-destructive mixing of the cells in the saline solution at a high ratio is a very serious problem.

Accordingly, it is another object of the invention to provide a flow mixer which is especially effective in non-destructive mixing of blood cells into a diluent liquid.

It is a recognized procedure in continuous flow batch processing apparatus to separate batches by means of air bubbles. However, it is important in such apparatus that the air bubbles are completely purged from the apparatus in order to assure complete cleansing of the apparatus between batches.

Accordingly, it is another object of the present invention to provide an improved flow mixing device from which air bubbles are efficiently purged, even when extremely small dimensions are employed.

Further objects and advantages of the invention will be apparent from the following description and the accompanying drawings.

In carrying out the invention, there may be employed a flowing fluid mixing device comprising a housing defining at least one chamber, a spherical body confined within said chamber, said housing defining an inlet opening communicating with one end of said chamber for receiving a plurality of substantially fluid, unmixed materials for transmission through said chamber and an outlet opening communicating with the other end of said chamber, the diameter of said spherical body being smaller than the diametric spacing of the walls of said chamber so as to permit free movement of said spherical body within said chamber.

Figure 1:
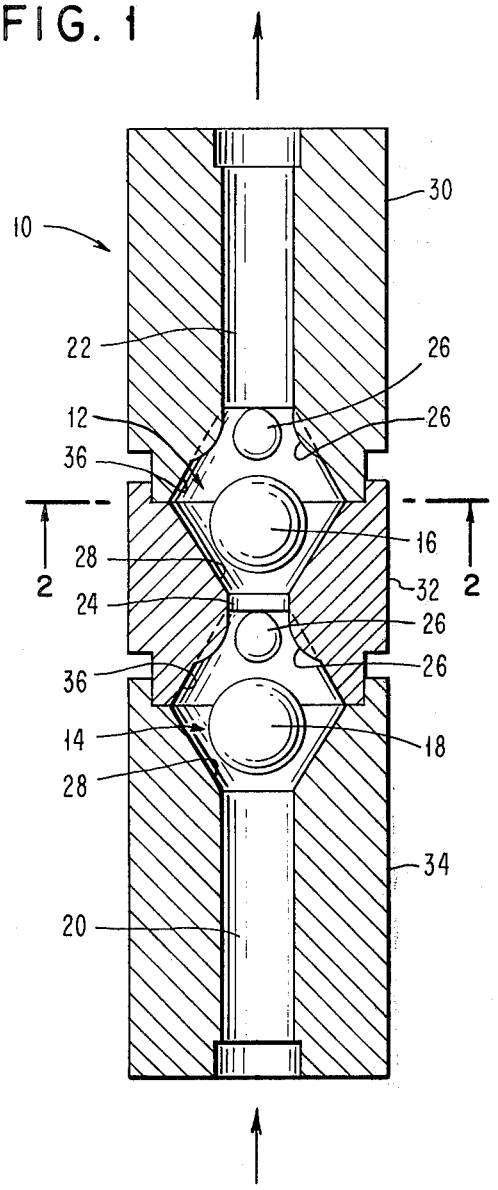
FIG. 1 is an enlarged sectional side view of a mixer in accordance with the present invention.

Referring more particularly to FIG. 1, there is provided a housing 10 enclosing one or more chambers 12 and 14. Within each chamber, there is confined a spherical body 16, 18 which preferably has a density substantially different from the density of the fluids which are to be mixed. The housing 10 also defines an inlet opening 20 for chamber 14 and an outlet opening 22 for chamber 12. The short passage 24 between chambers 14 and 12 serves as the outlet opening for chamber 14, and the inlet opening for chamber 12. Thus, the flow of fluid is vertically upward through the inlet 20, the chambers 14 and 12, and the outlet opening 22. In this embodiment, the spherical bodies 16 and 18 preferably have a substantially higher density than the fluids being mixed. Thus, where the effective specific gravity of the fluids is essentially equal to that of water, the spherical bodies may preferably consist of stainless steel balls. The spherical bodies 16 and 18 are thus biased by gravity towards the bottom of the associated chambers. Each spherical body, such as 18, is somewhat larger than the associated inlet passage 20, and also larger than the associated outlet opening so as to thereby confine the body within the chamber. The downward gravity bias of the spherical body 18 into the bottom of the chamber tends to close off the inlet opening 20. However, when fluid is flowing through the device, each spherical body is necessarily raised up by the pressure and flow of the fluid through the device to the positions approximating the positions illustrated in the drawing. Thus, the drawing substantially illustrates the operating positions of the spherical bodies.

The device, as illustrated, has been found to be very effective in accomplishing thorough mixing of fluids introduced at the inlet opening 20, even when the physical scale of the device is extremely small, with the diameters of the inlet and outlet openings 20, 22 at only about one millimeter. The reasons for the effectiveness of the device are not fully understood. Even though it is known that turbulence is induced on the downstream side of fluid flowing around a sphere, it is believed that other effects may also be important in the mixing action of the device. Thus, it has been observed that the spherical bodies have a tendency to orbit in position within the chamber as fluid passes through each chamber, and it is believed that the spherical bodies may also rotate to cause portions of the fluid adjacent to the spherical body surface to be transported by the rotation to enhance the mixing action.

Figure 2:
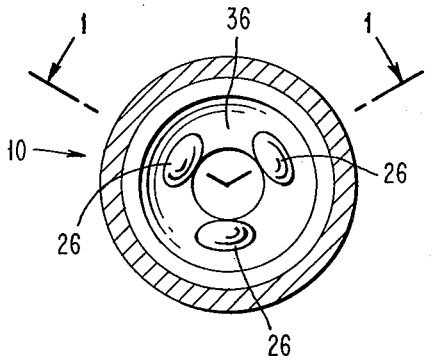
FIG. 2 is a sectional bottom view taken at section 2—2 of FIG. 1 to illustrate the interior configuration of the device.

In order to prevent a blockage caused by a pressure surge, or the passage of abnormally large gas bubbles through the mixer, which could cause one of the spherical bodies 18 to close up the outlet opening of the associated chamber, each chamber is provided with discontinuities in the vicinity of the outlet opening to permit the passage of fluid even though the spherical body may be in the uppermost position. In the illustrated preferred embodiment, these discontinuities are provided by hemispherical protrusions 26 extending into the chamber in the vicinity of the associated outlet opening. In the preferred embodiment, three of these protrusions are provided, and are equally spaced circumferentially around the outlet opening, particularly as illustrated in the bottom sectional view of FIG. 2. In order to more clearly illustrate the protrusions 26 in FIG. 1, the section of FIG. 1 is taken on a combination of section planes spaced 120° apart as illustrated at 1—1 in FIG. 2.

In order to provide the desired constricting effect of the spherical bodies with the associated lower portions of the chambers, the lower walls of each chamber, as indicated at 28, are smooth and circular adjacent to the associated inlet opening to thus provide a reasonably close fit with the outer surface of the spherical body. Each of these lower chamber surfaces are preferably formed as a frustum of a right circular cone. As illustrated in the drawing, the housing 10 is conveniently fabricated using separate housing parts 30, 32, and 34. The spherical bodies 16, 18 are thus conveniently assembled into the chambers as the chambers are closed by assembly of the housing parts. Accordingly, the conical surface 28 is conveniently continued upwardly to define the entire portion of the chamber wall formed by the inlet part 34 of the housing. Similarly, the conical surface 28 within the chamber 12 coincides with that part of the chamber 12 defined by the intermediate housing part 32. While the pitch angle of the cone surface 28 is not terribly critical, it has been found that if the cone is too shallow, the vertical alignment of the device must be very carefully established and maintained in order to achieve correct operation. Accordingly, the preferred pitch angle of the cone is as illustrated, with the cone surface at an angle in the neighborhood of 30° from the axis of the cone (coinciding with the flow axis of the device).

Similarly, the upper portion of each chamber is conveniently formed as a matching 30° frustum of a right circular cone, with the addition of the protrusions 26, as previously discussed above.

The mixing device of the present invention may consist of a single chamber with a single spherical body which may be assembled using the housing parts illustrated, by simply omitting the intermediate housing part 32. However, as illustrated, it is often preferable to employ more than one chamber, each with its own spherical body. Furthermore, more than two chambers may be provided with the mode of construction illustrated, by simply providing additional intermediate parts 32 for each added chamber. One very satisfactory practical embodiment of the invention employs four such chambers connected in series.

Figure 3:
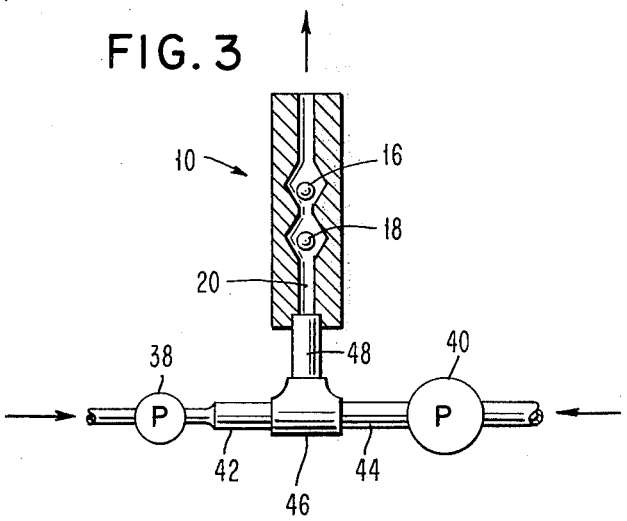
FIG. 3 is a schematic representation of the device in combination with fluid metering arrangements for feeding a combination of fluids to the device for mixing.

FIG. 3 schematically illustrates a combination including the mixing device of FIG. 1 in combination with separate fluid metering devices schematically shown as pumps 38 and 40. The pumps 38 and 40 may be positive displacement devices such as gear pumps which supply a precisely measured volume of fluid for each rotation of the pump. The pumps 38 and 40 are supplied with different fluids from fluid sources (not shown), and the fluids are pumped together through conduit means including separate conduits 42 and 44 connected by a T-fitting 46, and a common conduit 48 to the inlet 20 of the mixing device.

The pump 38 is illustrated as smaller than the pump 40 in order to emphasize the capability of the mixing device to deal with the mixing of different fluids having a high ratio between the flow volumes of the different fluids. As previously mentioned above, obtaining an adequate degree of mixing is particularly difficult with a high volume ratio between the different flowing fluids. In one practical embodiment of the invention employing a four chamber mixing device, very satisfactory mixing is achieved at a fluid volume ratio which is greater than 60 to 1.

Without intending to limit the scope of the invention, but by way of further describing and exemplifying a preferred embodiment of the invention, the following dimensions employed in an actual preferred embodiment are given, referring again to FIG. 1:

| (All linear dimensions are given in millimeters). | |
|---|---|
| Diameter of inlet opening 20 | 1.25 |
| Diameter of outlet opening 22 | 1.25 |
| Diameter of intermediate outlet (inlet) opening 24 | 1.02 |
| Maximum chamber diameter | 3.00 |
| Spherical body diameter | 1.59 |
| Cone angle from axis to curved surface on inlet side of chamber in part 34 | 30 degrees |
| Cone angle from axis to curved surface on inlet side of chamber in part 32 | 31.5 degrees |
| Cone angle from axis to curved surface on outlet side of chamber in part 32 | 31.5 degrees |
| Cone angle from axis to curved surface on outlet side of chamber in part 30 | 30 degrees |

In the embodiment for which the above dimensions are given, the inlet and outlet passages 20 and 22 are dimensioned to accommodate a conduit having an outside diameter corresponding generally to the inside diameter of those passages. The conduit has an inside diameter of 0.84 millimeters. The typical flow rate of fluids through the device exemplified by the above dimensions is 0.1 cubic centimeters per second.

Based upon the handling of fluids which are predominantly water, and based upon the above flow rate and the dimensions given above, computations of Reynolds numbers reveal extremely low values. These values serve to emphasize the important utility of the invention in achieving a thoroughly mixed combination of fluids. The computed value of the Reynolds number is actually less than 250. As previously mentioned above, any value less than 2000 results in laminar, non-turbulent (non-mixing) flow.

While this invention has been shown and described in connection with particular preferred embodiments various alterations and modifications will occur to those skilled in the art. Accordingly, the following claims are intended to define the valid scope of this invention over the prior art, and to cover all changes and modifications falling within the true spirit and valid scope of this invention.

I claim:

1. A flowing fluid mixing device comprising
a housing defining at least one chamber,
a single spherical body confined within said chamber,
said housing defining an inlet opening communicating with one end of said chamber and an outlet opening communicating with the other end of said chamber,
said outlet opening being the only inlet to said chamber,
means for supplying a plurality of substantially fluid unmixed materials to said inlet opening for transmission through said chamber,
the diameter of said spherical body being smaller than the diametric spacing of the walls of said chamber so as to permit free movement of said spherical body within said chamber.

2. A device as claimed in claim 1 wherein
said inlet and outlet openings are substantially vertically aligned with said chamber,
one of said openings being above said chamber and the other of said openings being below said chamber.

3. A device as claimed in claim 2 wherein
said device is designed for operation with fluids having a mass density within a predetermined range and said spherical body has a mass density substantially different from said fluids to thereby provide a gravity bias of said spherical body towards said inlet opening during device operation.

4. A device as claimed in claim 1 wherein
said outlet opening is constricted to a minimum dimension smaller than the diameter of said spherical body to retain said spherical body with said chamber,
the walls of said chamber adjacent to said outlet opening including discontinuities to prevent substantial closure of said outlet opening by the positioning of said spherical body adjacent to said outlet opening.

5. A flowing fluid mixing device comprising
a housing defining at least one chamber,
a single spherical body confined within said chamber,
said housing defining an inlet opening communicating with one end of said chamber for receiving a plurality of substantially fluid unmixed materials for transmission through said chamber and an outlet opening communicating with the other end of said chamber,
the diameter of said spherical body being smaller than the diametric spacing of the walls of said chamber so as to permit free movement of said spherical body within said chamber,
said inlet and outlet openings being substantially vertically aligned with said chamber,
said outlet opening being above said chamber and said inlet opening being below said chamber,
said device being designed for operation with fluids having a mass density within a predetermined range and said spherical body having a mass density substantially greater than the mass density of said fluids to thereby provide a gravity bias of said spherical body towards said inlet opening during device operation.

6. A device as claimed in claim 5 wherein
said inlet opening is constricted to a diameter smaller than the diameter of said spherical body and wherein the walls of said chamber are smooth and circular adjacent to said inlet opening to provide a substantial constriction of said inlet opening by said spherical body in the absence of fluid movement from said inlet opening into said chamber, said spherical body and said chamber being operable to provide for upward levitational movement of said spherical body in said chamber to reduce said constriction of said inlet opening in response to fluid forced into said chamber through said inlet opening.

7. A device as claimed in claim 6 wherein the walls of said chamber adjacent to said inlet opening define a frustum of a right circular cone.

8. A device as claimed in claim 7 wherein the axis of said cone is substantially vertical, and wherein the angle from the axis of said cone to the curved surface of said cone is in the neighborhood of 30°.

9. A device as claimed in claim 6 wherein said outlet opening is constricted to a diameter smaller than the diameter of said spherical body to retain said spherical body within said chamber.

10. A device as claimed in claim 9 wherein the walls of said chamber adjacent to said outlet opening include discontinuities to prevent substantial closure of said outlet opening by the positioning of said spherical body adjacent to said outlet opening.

11. A device as claimed in claim 10 wherein the walls of said chamber adjacent to said outlet opening define a frustum of a right circular cone, and wherein said discontinuities are provided by a plurality of protrusions extending into said chamber from said wall of said chamber adjacent to said outlet opening, said protrusions being equally spaced around said outlet opening.

12. A device as claimed in claim 6 wherein said spherical body comprises a substantially smooth sphere.

13. A device as claimed in claim 12 wherein said spherical body is comprised of stainless steel.

14. A device as claimed in claim 6 wherein said housing includes a plurality of chambers connected serially with a separate spherical body in each of said chambers.

15. A flowing fluid mixing device as claimed in claim 6 including a plurality of fluid volume metering devices for metering different fluids, and conduit means connected to receive fluids from said respective metering devices and connected to said housing inlet for conveying the different fluids from said metering devices together to said housing inlet.

16. A device as claimed in claim 15 wherein said fluid metering devices are positive displacement metering devices providing a fixed high ratio between the volumes of two of said fluids delivered to said housing inlet.

17. A device as claimed in claim 16 wherein said ratio is in the order of 60 to 1.

18. A device as claimed in claim 6 wherein said device is operable to deal with small quantities of fluids supplied from small fluid conduits, the size of said inlet and outlet openings being in the order of one millimeter in diameter.

19. A method of mixing a flowing combination of fluids comprising directing the combination of fluids upwardly under pressure into a chamber containing a single ball which has a density substantially greater than said fluids and thereby causing the ball to be lifted and orbited within the chamber.

* * * * *

UNITED STATES PATENT AND TRADEMARK OFFICE

CERTIFICATE OF CORRECTION

PATENT NO. : 4,019,721

DATED : April 26, 1977

INVENTOR(S) : Rene J. Langner

It is certified that error appears in the above-identified patent and that said Letters Patent are hereby corrected as shown below:

Column 6, line 9, "outlet" should read --inlet--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*